US005558498A

United States Patent [19]

Ogino

[11] Patent Number: 5,558,498

[45] Date of Patent: Sep. 24, 1996

[54] PROPELLER SHAFT ASSEMBLY FOR MARINE PROPULSION SYSTEM

[75] Inventor: Hiroshi Ogino, Hamamatsu, Japan

[73] Assignee: Sanshin Kogyo Kabushiki Kaisha, Hamamtsu, Japan

[21] Appl. No.: 455,084

[22] Filed: May 31, 1995

[30] Foreign Application Priority Data

May 31, 1994 [JP] Japan ..... 6-118710

[51] Int. Cl.[6] ..... B63H 20/00

[52] U.S. Cl. ..... 416/129; 416/170 R; 440/80

[58] Field of Search ..... 416/93 A, 128, 416/129, 170 R; 440/80

[56] References Cited

U.S. PATENT DOCUMENTS

| | | |
|---|---|---|
| 537,612 | 4/1895 | Leathers . |
| 599,125 | 2/1898 | Fefel . |
| 624,674 | 5/1899 | Painton . |
| 938,911 | 11/1909 | Taylor . |
| 1,807,254 | 5/1931 | Piano . |
| 1,813,552 | 7/1931 | Stechauner . |
| 1,853,694 | 4/1932 | Melcher . |
| 2,058,361 | 10/1936 | Sherwood . |
| 2,064,195 | 12/1936 | De Michelis . |
| 2,347,906 | 5/1944 | Hatcher . |
| 2,372,247 | 3/1945 | Billing . |
| 2,672,115 | 3/1954 | Conover . |
| 2,987,031 | 6/1961 | Odden . |
| 2,989,022 | 6/1961 | Lundquist . |
| 3,478,620 | 11/1969 | Shimanckas . |
| 3,769,930 | 11/1973 | Pinkerton . |
| 4,529,387 | 7/1985 | Brandt . |
| 4,540,369 | 9/1985 | Caires . |
| 4,619,584 | 10/1986 | Brandt . |
| 4,642,059 | 2/1987 | Nohara . |
| 4,741,670 | 5/1988 | Brandt . |
| 4,767,269 | 8/1988 | Brandt . |
| 4,790,782 | 12/1988 | McCormick . |
| 4,792,314 | 12/1988 | McCormick . |
| 4,793,773 | 12/1988 | Kinouchi et al. . |
| 4,795,382 | 1/1989 | McCormick . |
| 4,828,518 | 5/1989 | Kouda et al. . |
| 4,832,570 | 5/1989 | Solia . |
| 4,832,636 | 5/1989 | McCormick . |
| 4,840,136 | 6/1989 | Brandt . |
| 4,887,982 | 12/1989 | Newman et al. . |
| 4,887,983 | 12/1989 | Bankstahl et al. . |
| 4,897,058 | 1/1990 | McCormick . |
| 4,932,907 | 6/1990 | Newman et al. . |
| 4,963,108 | 10/1990 | Koda et al. . |
| 4,993,848 | 2/1991 | John et al. . |
| 5,009,621 | 4/1991 | Bankstahl et al. . |
| 5,017,168 | 5/1991 | Ackley . |
| 5,030,149 | 7/1991 | Fujita . |
| 5,186,609 | 2/1993 | Inoue et al. . |
| 5,230,644 | 7/1993 | Meisenburg et al. . |
| 5,232,386 | 8/1993 | Gifford . |
| 5,249,995 | 10/1993 | Meisenburg et al. . |
| 5,342,228 | 8/1994 | Magee et al. . |
| 5,344,349 | 9/1994 | Meisenburg et al. . |
| 5,352,141 | 10/1994 | Shields et al. . |
| 5,366,398 | 11/1994 | Meisenburg et al. . |
| 5,449,306 | 9/1995 | Nakayasu et al. ..... 416/129 |

FOREIGN PATENT DOCUMENTS

| | | | |
|---|---|---|---|
| 60-259594 | 12/1985 | Japan | 416/134 R |
| 64-28093 | 1/1989 | Japan | 440/80 |
| 1-309890 | 12/1989 | Japan | 440/80 |

*Primary Examiner*—James Larson

*Attorney, Agent, or Firm*—Knobbe, Martens, Olson & Bear

[57] ABSTRACT

A simple structured propeller shaft assembly for a counter-rotating propeller system of a watercraft outboard drive prevents fishing line, weeds and like debris from entangling on a shaft of the propeller system and damaging the lubricant seals of the shaft assembly. The shaft assembly includes a nut which threads partially onto an end of an outer propeller shaft of the propeller shaft assembly. A thrust washer, carrier by an inner propeller shaft, includes a front hub which partially inserts into the nut adjacent to the end of the outer shaft. The nut, thrust washer and outer shaft end together define a labyrinth path into the space occupied by the lubricant seals between the inner and outer shafts. This labyrinth path inhibits weeds and like debris from wrapping around the inner shaft at a point adjacent to the lubricant seals.

26 Claims, 7 Drawing Sheets

PROPELLER SHAFT ASSEMBLY FOR MARINE PROPULSION SYSTEM

BACKGROUND OF THE INVENTION

1. Field of the Invention

The present invention relates in general to a marine propulsion system, and more particularly to a propeller shaft assembly for a propulsion system of an outboard drive.

2. Description of Related Art

Many outboard drives of marine watercrafts employ counter-rotational propeller systems which utilize a pair of counter-rotating propellers that operate in series about a common rotational axis. By using propeller blades having a pitch of opposite hands, the dual propeller arrangement provides significant improvement in propulsion efficiency. Such propulsion systems are common in both outboard motors and in stern drive units of inboard/outboard motors.

Counter-rotational propeller systems typically include an inner propeller shaft and a hollow outer propeller shaft through which the inner propeller shaft passes. Under at least one drive condition (e.g., forward drive), the inner shaft rotates in an opposite direction from that of the outer shaft. Commonly, the inner shaft drives a rear propeller and the outer shaft drives an adjacent front propeller.

Some prior counter-rotational propeller systems include a cover to surround the end of the outer propeller shaft to prevent fishing line or weeds from entangling on the inner shaft and damaging oil seals, which are typically disposed between the inner shaft and the outer shaft at the rear end of the outer shaft. As described below in greater detail, such covers are usually positioned between the propeller hubs of the propellers.

Although prior covers disposed over the rear end of the outer shaft generally prevent fishing line and weeds from wrapping around the inner shaft at the interface between the propeller hubs, such covers complicate the propeller shaft assembly, adding to the expense of the drive. Such covers also wear and require replacement, and complicate the process of assembling the propulsion system.

SUMMARY OF THE INVENTION

A need therefore exists for a simple structured propeller shaft arrangement which protects the oil seals between the inner and outer shafts.

In accordance with one aspect of the present invention, a propulsion shaft assembly for a marine propulsion system comprises a hollow outer shaft and a coaxial inner shaft. The inner shaft extends beyond a rear end of the outer shaft, and the inner and outer shafts are arranged to define a space between an inner diameter of the hollow outer shaft and an outer diameter of the inner shaft. The inner shaft carries a thrust washer at a position proximate to the rear end of the outer shaft. The outer shaft carries a hollow end cap carrier at its rear end. A portion of the end cap covers a portion of the thrust flange so as to form a generally labyrinth path into the space defined between the inner and outer shafts.

Another aspect of the present invention involves a propeller shaft assembly for a counter-rotating propeller system. The shaft assembly comprises an inner shaft which passes through and extends beyond a rear end of a coaxial outer propeller shaft. The shafts extends along a common drive axis. At least one lubricant seal is positioned between the inner and outer shaft proximate to the rear end of the outer shaft. A first member is coupled to the inner shaft in a manner allowing the transfer of a forward thrust loading on the first member to the inner shaft. A second member is coupled to the outer shaft. The first and second members overlaps in the direction of the drive axis to protect the lubricant seal.

An additional aspect of the present invention involves a propulsion shaft assembly for a marine drive. The propulsion shaft assembly comprises first and second coaxial, counter-rotating propulsion shafts which together define a space between them. The first shaft is arranged to extend beyond an end of the second shaft. The first shaft includes a first member which circumscribes the first shaft, and the second shaft includes a second member which releasably attaches to the second shaft to secure a propulsion device to the second shaft. The first and second members are arranged relative to each other to form a labyrinth path into the space between the first and second shafts.

In accordance with another aspect of the present invention, a propulsion system for a marine drive comprises first and second coaxial, counter-rotating propulsion shafts. The shafts extend along a drive axis. The first shaft is coupled to a first propeller hub and the second shaft is coupled to a second propeller hub. The first and second propeller hubs are arranged in series adjacent to each other with adjacent ends of the propeller hubs overlapping in the direction of the drive axis. The overlapping ends are spaced apart in a direction transverse from the drive axis by a first distance. The first hub is supported about the first propulsion shaft at a second distance from a contact surface connected to the first propulsion shaft. The second distance is smaller than the first distance.

BRIEF DESCRIPTION OF THE DRAWINGS

These and other features of the invention will now be described with reference to the following drawings which, in general, illustrate a prior propeller shaft assembly and an exemplary embodiment of the present propeller shaft assembly. The following drawing descriptions specifically describe the subject matter of each drawing.

DETAILED DESCRIPTION OF EMBODIMENTS OF PRIOR AND PRESENT PROPELLER SHAFT ASSEMBLIES

Figure 1:
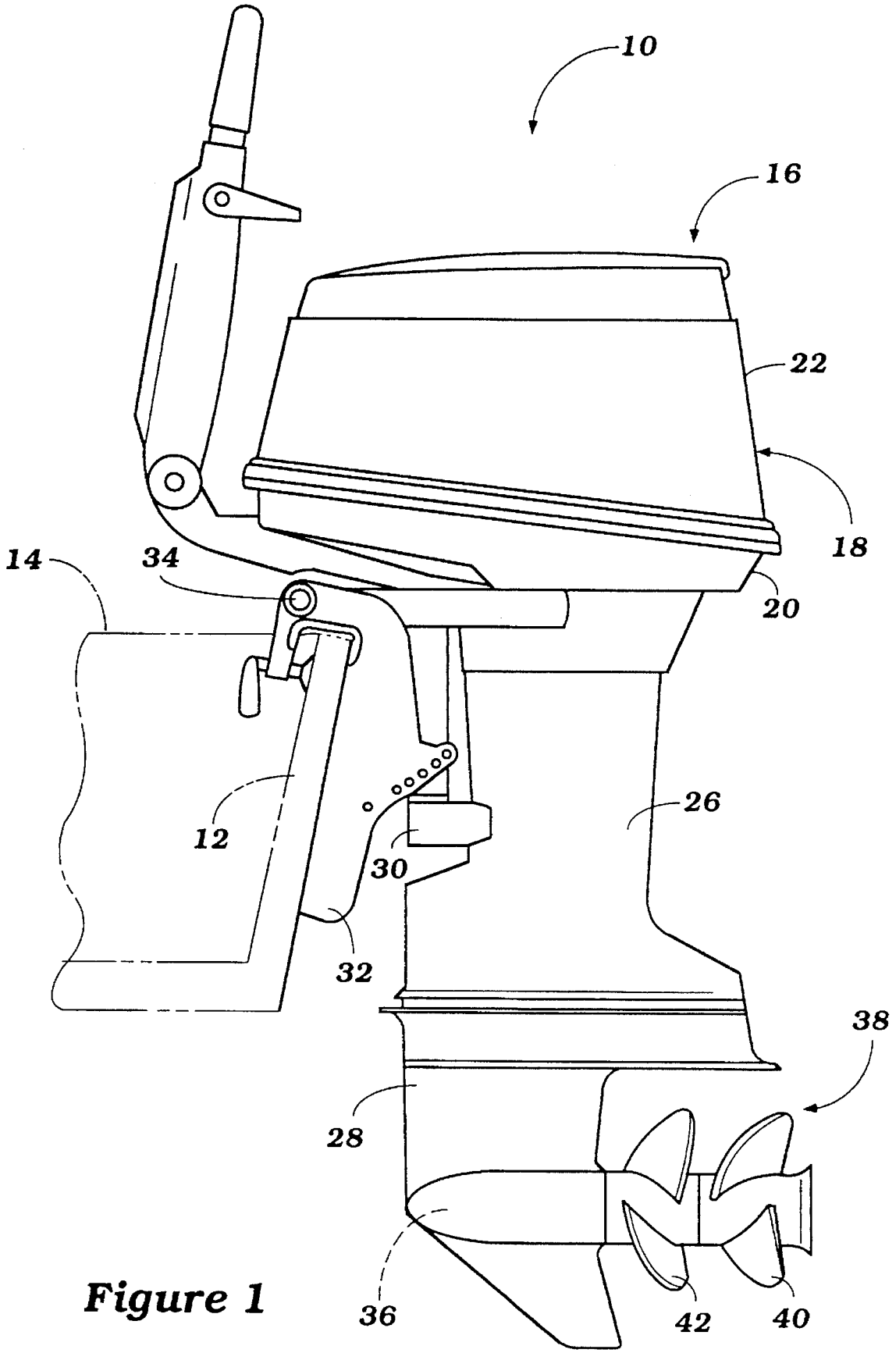
FIG. 1 is a side elevational view of a conventional outboard drive which can embody either the prior or present propulsion shaft assemblies.

FIG. 1 illustrates a conventional marine outboard drive 10 of a type in which the present propeller shaft assembly can be incorporated. In the illustrated embodiment, the outboard drive 10 is depicted as an outboard motor for mounting on a transom 12 of a watercraft 14. It is contemplated, however, that those skilled in the art will readily appreciate that the present propeller shaft assembly can be applied to stern drive units of inboard-outboard motors and to other types of watercraft drive units as well.

In the illustrated embodiment, the outboard drive 10 has a power head 16 which includes an engine (not shown). A conventional cowling 18 surrounds the engine. The cowling 18 desirably includes a lower tray 20 and a top cowling member 22. These components 20, 22 of the protective cowling 18 together define an engine compartment which houses the engine.

The engine is mounted conventionally with its outward shaft (i.e., a crankshaft) rotating about a generally vertical axis. The crankshaft (not shown) drives a drive shaft 24 (FIG. 3), as known in the art. The drive shaft 24 depends from the power head 16 of the outboard drive 10.

A drive shaft housing 26 extends downward from the lower tray 20 and terminates in a lower unit 28. The drive shaft 24 extends through and is journaled within the drive shaft housing 26, as known in the art.

The engine includes an exhaust system which discharges exhaust gases through an exhaust pipe (not shown). The exhaust pipe depends from the engine into an exhaust expansion chamber 29 (FIG. 3) formed in the drive shaft housing 26.

As seen in FIG. 1, a steering bracket 30 is attached to the drive shaft housing 26 in a known manner. The steering bracket 30 also is pivotally connected to a clamping bracket 32 by a pin 34. The clamping bracket 32, in turn, is configured to attach to the transom 12 of the watercraft 14. This conventional coupling permits the outboard drive 10 to be pivoted relative to the steering bracket 30 for steering purposes, as well as to be pivoted relative to the pin 34 to permit adjustment to the trim position of the outboard drive and for tilt up of the outboard drive 10. Although not illustrated, it is understood that a conventional hydraulic tilt and trim cylinder assembly, as well as a conventional hydraulic steering cylinder assembly could be used as well with the present outboard drive 10.

The lower unit 28 houses a transmission 36 which selectively establishes a driving condition of a propulsion device 38, such as, for example, a propeller, a hydrodynamic jet, or the like. The transmission 36 advantageously is a forward-neutral-reverse type transmission. In this manner, the propulsion device 38 can drive the watercraft in any of these three operating states.

The present transmission 36 is particularly well suited for use with a counter-rotational propulsion device 38. In the illustrated embodiment, the propulsion device 38 includes a rear propeller 40 designed to spin in one direction and to assert a forward thrust, and a front propeller 42 designed to spin in an opposite direction and to assert a forward thrust. The terms "front" and "rear", which are used herein to describe the components of the lower unit 28, are used in reference to the transom 12 of the watercraft 14. The present propulsion shaft assembly, however, can be used with other types of propulsion devices, such as, for example, a two stage hydrodynamic jet system.

Prior Propeller Shaft Assembly

In order to assist the reader's understanding and appreciation of the present propeller shaft assembly, the following first briefly describes a prior propeller shaft assembly used with the above-described type of outboard motor, and then describe in detail the present propeller shaft assembly, together with the related transmission system and lower unit. The components of the prior propeller shaft assembly will be identified by reference numerals beginning with "100" and the components of the present lower unit will be identified by reference numerals beginning in the "200s" in order to prevent confusion between the prior and present propeller shaft assemblies.

Figure 2:
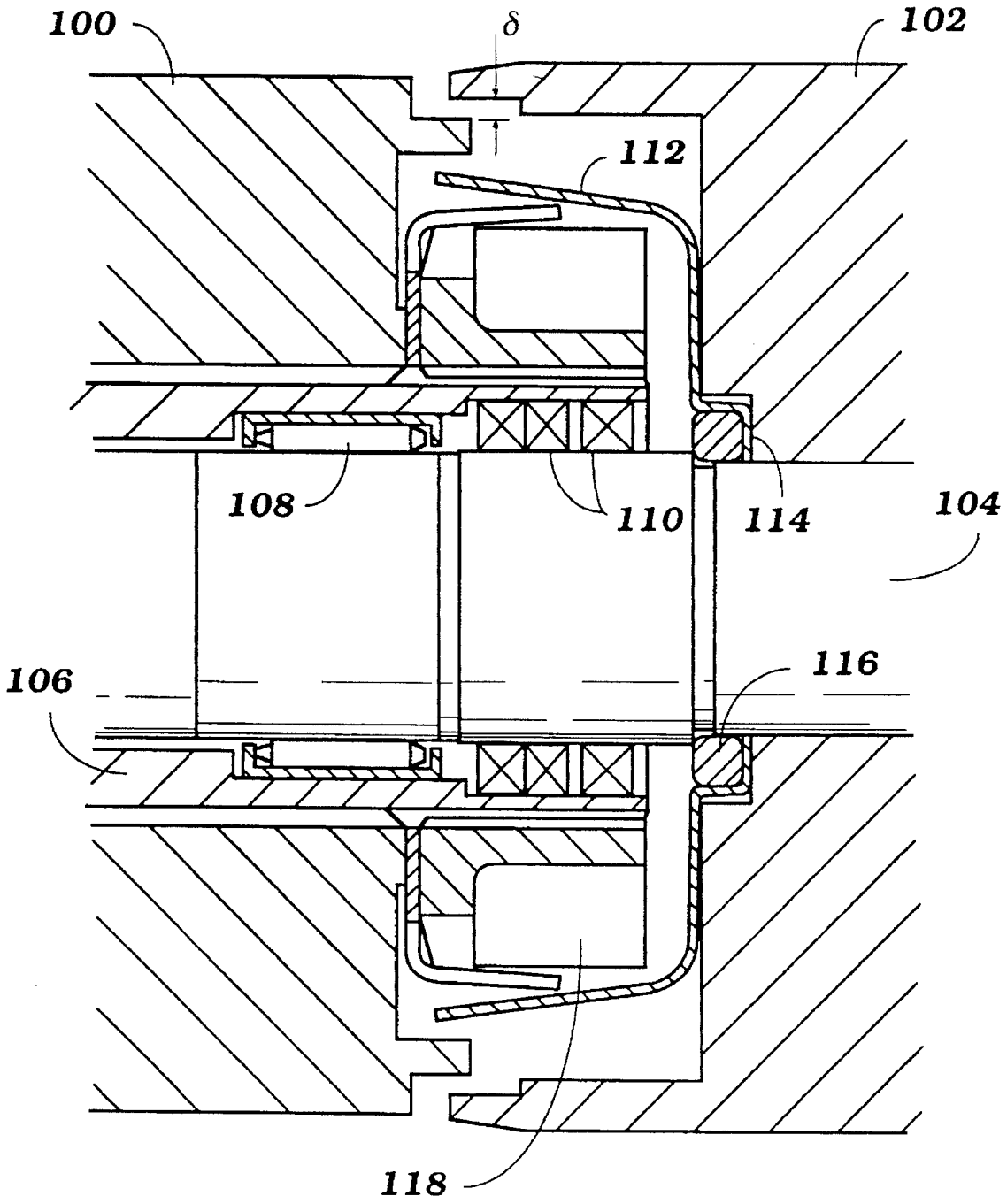
Figure 2 Prior Art
FIG. 2 is an enlarged, sectional side elevational view of a prior propeller shaft assembly at an interface region between front and rear propellers.

With reference to FIGS. 1 and 2, prior propulsion systems commonly include a pair of propeller hubs 100, 102 from which one or more propeller blades integrally extend. The propeller hubs 100, 102 are arranged in series with the adjacent ends of the hubs 100, 102 overlapping. As seen in FIG. 2, a large gap δ is formed between the hubs 100, 102 in order to prevent contact between the hubs 100, 102, which rotate in opposite directions.

As best understood from FIG. 2, an inner shaft 104 drives the hub 102 of the rear propeller 40, while an outer hollow shaft 106 drives the hub 100 of the front propeller 42. The inner shaft 104 extends through the hollow outer shaft 106. A needle bearing assembly 108 journals the inner shaft 104 within the outer shaft 106 at the rear end of the outer shaft 106.

At least one oil seal 110 commonly lies between the inner and outer shafts 104, 106 at a point behind the needle bearing assembly 108. Lubricant thus can flow between the shafts 104, 106 and through the bearing assembly 108, but the seals 110 prevent lubricant flow beyond this point.

As noted above, weeds and like debris can enter the space between the hubs 100, 102 through the gap δ and wrap around the inner shaft 104. Once entangled on the inner shaft 104, the debris commonly migrates into the seals 110, thereby degrading and/or damaging the seals 110.

Some prior propeller shaft assemblies have included a cover 112 disposed over the rear end of the outer shaft 106 to prevent fishing line, weeds and like debris from wrapping around the inner shaft 104 at the interface between the propeller hubs 100, 102. FIG. 2 illustrate a type of conventional annular cover 112. The cover 112 includes an end 114 which is captured between a thrust washer 116 and the rear propeller hub 102. The cover 112 flares outwardly toward the front hub 100 to cover the rear end of the outer shaft 106 and a retaining nut 118. The nut 118 is threaded completely onto the end of the outer shaft 106 to hold the front propeller hub 100 on the outer shaft 106.

Although somewhat effective in inhibiting weeds, fishing line and like debris from wrapping around the inner shaft 104 proximate to the oil seals 110, such prior covers 112 complicate the propeller shaft assembly and add additional expense to the drive. And, as noted above, they also wear and require replacement, and complicate the process of assembling the propulsion system.

Embodiment of the Present Propeller Shaft Assembly And Related Lower Unit Components The following will first describe the individual components of a transmission and actuator mechanism preferably used with the present propeller shaft assembly and then will describe the present propeller shaft assembly in detail.

Transmission

Figure 3:
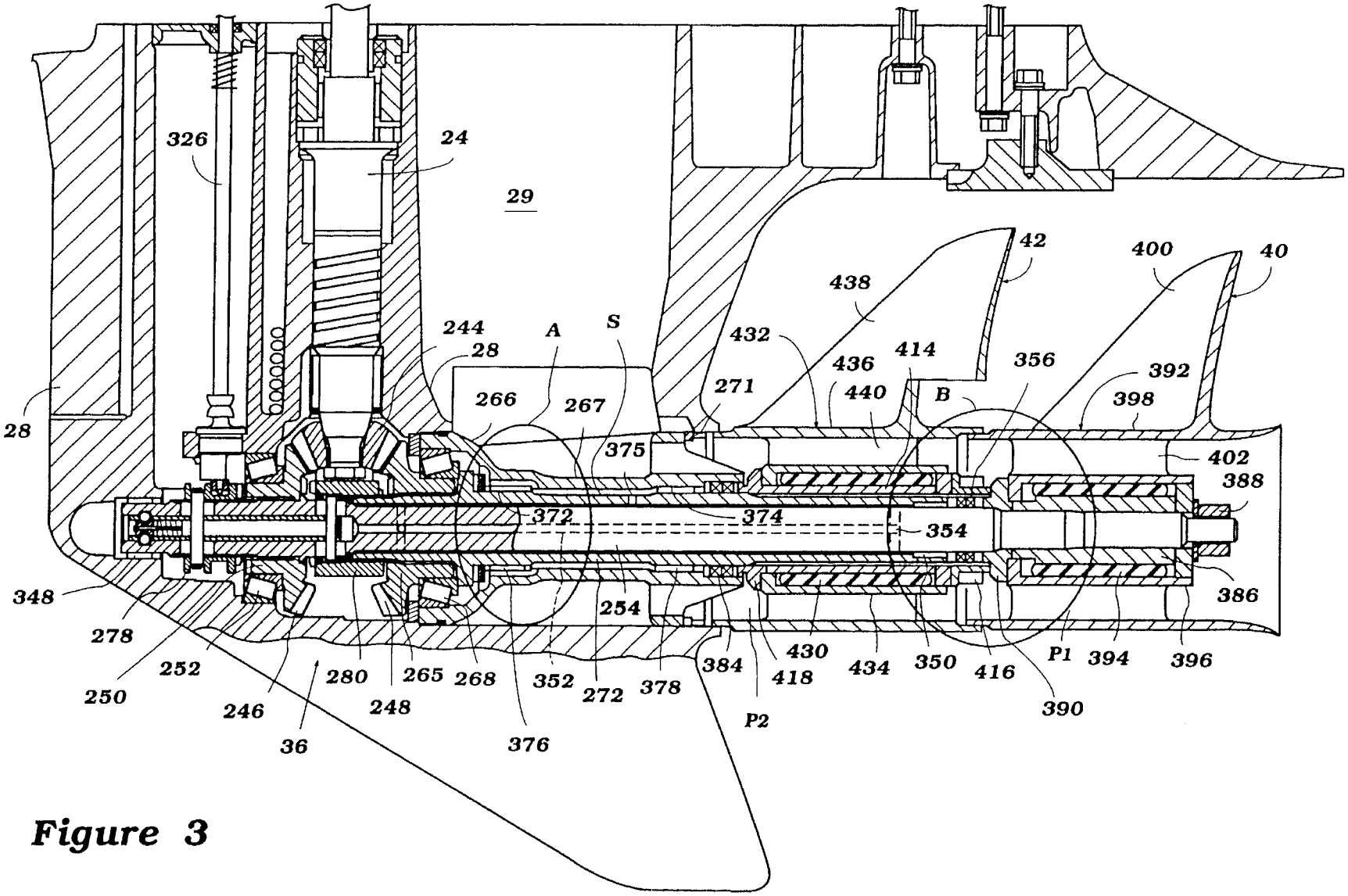
FIG. 3 is a sectional, side elevational view of a lower unit of an outboard drive configured in accordance with a preferred embodiment of the present invention.

The transmission 36 illustrated in FIG. 3 is generally configured in accordance with the description provided in copending application Ser. No. 08/346,397, filed on Nov. 29, 1994, in the name of Hiroshi Ogino, entitled Outboard Transmission System, and assigned to the assignee hereof, which is hereby incorporated by reference. The present propulsion shaft assembly, however, can be used with other types, configurations and layouts of transmissions.

Figure 4:
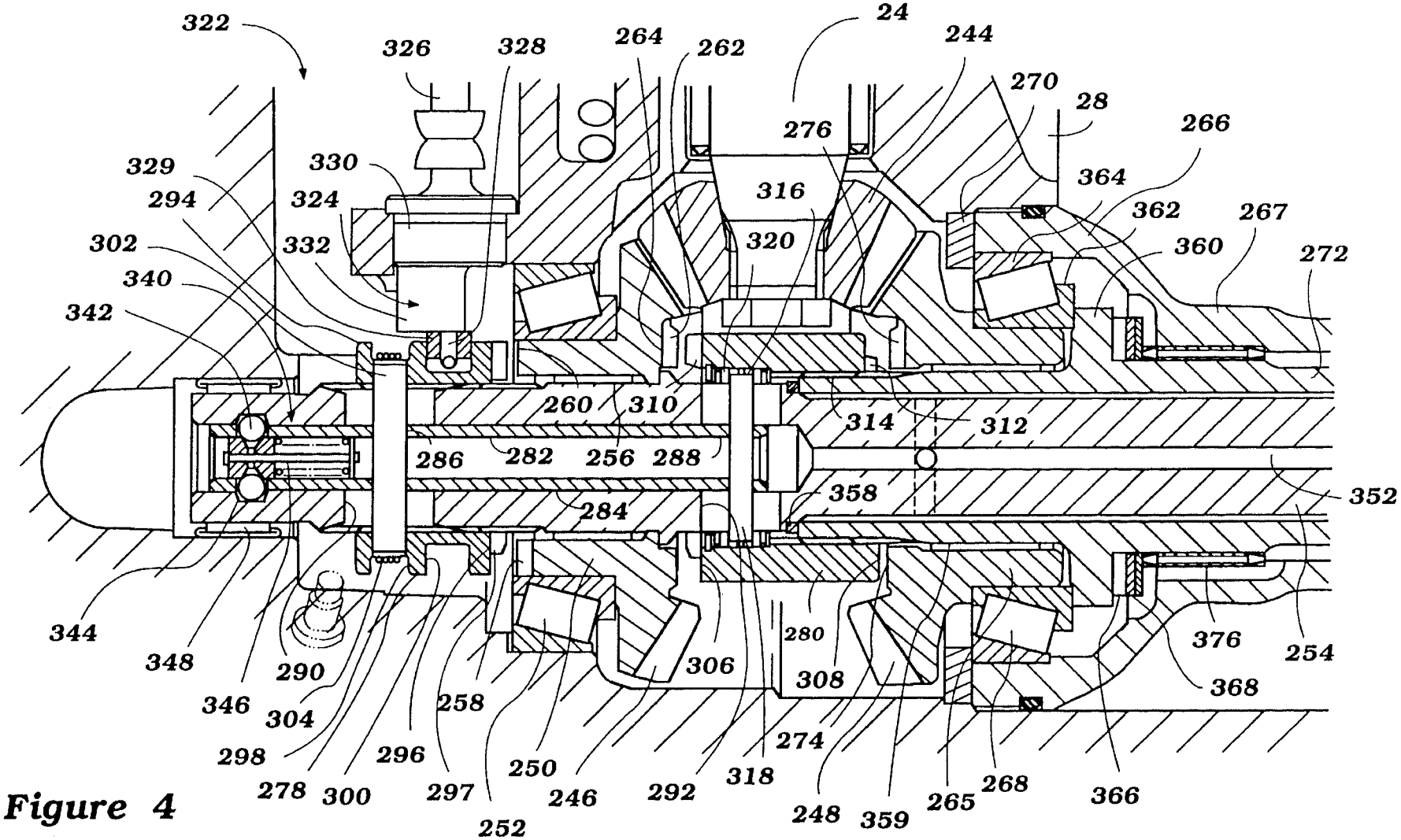
FIG. 4 is an enlarged, sectional side elevational view of a transmission of the lower unit of FIG. 3.

FIGS. 3 and 4 best illustrate the components of the exemplary transmission used with the present propulsion shaft assembly. As seen in these figures, the drive shaft 24 carries a drive gear or pinion 244 at its lower end, which is disposed within the lower unit 28 and which forms a portion of the transmission 36. The drive gear 244 preferably is a bevel type gear.

The transmission 36 also includes a pair of counter-rotating driven gears 246, 248 that are in mesh engagement with the drive gear 244. The pair of driven gears 246, 248 preferably are positioned on diametrically opposite sides of the drive gear 244, and are suitably journaled within the lower unit 28 as described below. Each driven gear 246, 248 is positioned at about a 90° shaft angle with the drive gear 244; however, the drive gear 244 and the driven gears 246, 248 can be positioned at other shaft angles.

In the illustrated embodiment, the pair of driven gears are a front bevel gear 246 and an opposing rear bevel gear 248. The front bevel gear 246 includes a hub 250 which is journaled within the lower unit 28 by front thrust bearing 252. The thrust bearing 252 rotatably supports the front gear 246 in mesh engagement with the drive gear 244.

As best seen in FIG. 4, the hub 250 has a central bore through which an inner propulsion shaft 254 passes when assembled. A metal bushing 256 journals the inner propulsion shaft 254 within the central bore of the front gear hub 250.

The front gear 246 also includes a series of teeth 258 on an annular front facing engagement surface 260, and includes a series of teeth 262 on an annular rear facing engagement surface 264. The teeth 258, 262 on each surface 260, 264 positively engage a portion of a clutch of the transmission 36, as discussed below.

As seen in FIG. 4, the rear gear 248 also includes a hub 265 which is suitably journaled within an enlarged front end 266 of a bearing carrier 267 of the lower unit 28 by a rear thrust bearing 268. The rear thrust bearing 268 rotatably supports the rear gear 248 in mesh engagement with the drive gear 244.

A shim ring 270, fixed within the lower unit 28, positions the bearing carrier 267 within the lower unit 28. A ring nut 271 threaded into a hole in the rear face of the lower unit 28 positions and secures the bearing carrier 267 in the lower unit 28.

The hub 265 of the rear gear 248 has a central bore through which the inner propulsion shaft 254 and an outer propulsion shaft 272 pass when assembled. The rear gear 248 also includes an annular front engagement surface 274 which carries a series of teeth 276 for positive engagement with a clutch of the transmission 36, as discussed below.

The transmission 36 also includes a front clutch 278 and a rear clutch 280 coupled to a plunger 282. The front clutch 278 selectively couples the inner propulsion shaft 254 to the front gear 246. The rear clutch 280 selectively couples the outer propulsion shaft 272 either to the front gear 246 or to the rear gear 248. FIG. 4 illustrates the front clutch 278 and the rear clutch 280 set in a neutral position (i.e., in a position in which the clutches 278, 280 do not engage either the front gear 246 or the rear gear 248). In the illustrated embodiment, the clutches 278, 280 are positive clutches, such as, for example, dog clutches; however, it is contemplated that the present transmission could be designed with friction-type clutches.

The plunger 282 has a generally cylindrical rod shape and slides within a longitudinal bore 284 of the inner shaft 254 to actuate the clutches 278, 280. The plunger 282 may be solid; however, it is preferred that the plunger 282 be hollow (i.e., a cylindrical tube), especially where a neutral detent mechanism of the type described below is used.

The plunger 282 includes a front hole 286 that is positioned generally transverse to the longitudinal axis of the plunger 282 and a rear hole 288 that is likewise positioned generally transverse to the longitudinal axis of the plunger 282. Each hole 286, 288 desirably is located symmetrically in relation to a corresponding aperture 290, 292 of the inner propulsion shaft 254.

As seen in FIG. 4, the front clutch 278 has a generally cylindrical shape that includes an axial bore which extends between an annular front end 294 and a flat annular rear end 296. The axial bore is sized to receive the inner propulsion shaft 254 and carries internal splines on its inner wall.

The rear end surface 296 of the clutch 278 extends generally transverse to the longitudinal axis of the clutch 278. The rear surface 296 of the front clutch 278 is substantially coextensive in area with the annular front surface 260 of the front gear 246. Teeth 297 extend from the clutch rear surface 296 in the longitudinal direction and desirably correspond to the teeth 258 of the front surface 260 of the front gear 246 in size (e.g., axial length) and in configuration. In the illustrated embodiment, the front clutch 278 and the front gear 246 each includes three teeth 258, 297, respectively, on their corresponding ends; however, it is contemplated that the clutch 278 and gear 246 could have any number of teeth in order to suit a specific application.

A pair of annular grooves circumscribe the exterior of the front clutch 278. A front groove 298 is sized to receive a retaining spring, as discussed below. The rear groove 300 is sized to cooperate with a portion of an actuator mechanism, which also will be described below.

As understood from FIG. 4, the front clutch 278 includes a transverse hole that extends through the clutch 278 at the location of the front annular groove 298. The hole is sized to receive a pin 302 which, when passed through the front aperture 290 of the inner propulsion shaft 254 and through the front hole 286 of the plunger 282, interconnects the plunger 282 and the front clutch 278 with the front clutch 278 positioned on the inner propulsion shaft 254. The pin 302 may be held in place by a press-fit connection between the pin 302 and the front hole of the clutch 278 or by a conventional coil spring 304 which is contained within the front annular groove 298 about the exterior of the front clutch 278.

The rear clutch 280 is disposed between the two counter-rotating driven gears 246, 248. The rear clutch 280 has a tubular shape that includes an axial bore which extends between an annular front end 306 and an annular rear end 308. The bore is sized to receive a portion of the outer propulsion shaft 272 positioned about the inner propulsion shaft 254.

The annular end surfaces 306, 308 of the rear clutch 280 are substantially coextensive in size with the annular engagement surfaces 264, 274 of the front and rear gears 246, 248, respectively. Teeth 310 extend from the front end 306 of the rear clutch 280 and desirably correspond to the respective teeth 262 of the front gear 246 in size (e.g., axial length), in number, and in configuration. Teeth 312 likewise extend from the rear end surface 308 of the rear clutch 280 and desirably correspond to the respective teeth 276 of the rear gear 48 in size (e.g., axial length), in number, and in configuration.

As seen in FIG. 4, the rear clutch 280 is coupled to the outer propulsion shaft 272 through a spline connection 314. The clutch 280 thus drives the outer propulsion shaft 272 through the spline connection 314 between the rear clutch 280 and the shaft 272, yet the clutch 280 can slide along the axis of the shaft 272 between the front and rear gears 246, 248. The rear clutch 280 specifically includes internal splines within the bore that mate with corresponding external splines on the outer periphery of the outer propulsion shaft 272 to from the spline connection 314.

The rear clutch 280 also includes a counterbore 316. The counterbore 316 is sized to receive a pin 318 which extends through the rear aperture 292 of the inner propulsion shaft 254 and through the rear hole 288 of the plunger 282 when assembled. The ends of the pin 318 desirably are captured by an annular bushing 320 which is interposed between a pair of roller bearings (not shown). The assembly of the bushings and bearings is captured between a pair of washers and locked within the counterbore 316 of the clutch 280 by a retaining ring. The roller bearings journal the bushing 320 and pin 318 assembly within the counterbore 316 of the rear clutch 280 to allow the bushing 320 and pin 318 to rotate in an opposite direction from the rear clutch 280. The pin 318, being captured within the counterbore 316 of the rear clutch 280, couples together the plunger 282 and the rear clutch 280 in order for the plunger 282 to actuate the rear clutch 280, as discussed below.

Actuator Mechanism

With continual reference to FIG. 4, an actuator mechanism 322 moves the plunger 282 from a position establishing a forward drive condition, in which the front and rear clutches 278, 280 engage the first and second gears 246, 248, respectively, through a position of non-engagement (i.e., the neutral position) and to a position establishing a reverse drive condition, in which the rear clutch 280 engages the front gear 246. The actuator mechanism 322 positively reciprocates the plunger 282 between these positions.

The actuator mechanism 322 includes a cam member 324 that connects the plunger 282 to a rotatable shift rod 326. In the illustrated embodiment, the shift rod 326 is journaled for rotation in the lower unit 28 and extends upwardly to a transmission actuator mechanism (not shown). The actuator mechanism 322 converts rotational movement of the shift rod 326 into linear movement of the plunger 282 to move the plunger 282 and the clutches 278, 280 generally along the axis of the propulsion shafts 254, 272.

The cam member 324 is affixed to the lower end of the shift rod 326. The cam member 324 includes an eccentrically positioned drive pin 328 which extends into the rear groove 300 of the front clutch 278. Anti-friction washers 329 journal the pin 328 within the rear groove 300 of the front clutch 278. The cam member 324 thus is coupled to the front clutch 278 in a manner in which rotational movement of the cam member 324 moves the front clutch 278 linearly along the inner drive shaft 254, while permitting the clutch 278 to rotate with the inner propeller shaft 254, relative to the cam member 324.

The cam member 324 also includes a cylindrical upper bearing 330 and a smaller diameter, cylindrical lower member 332. The upper bearing 330 is positioned to rotate about the axis of the shift rod 326 and as seen in FIG. 4, is suitably journaled within an upper bore of the lower unit 28. The lower member 332 is eccentrically positioned relative to the axis of the shift rod 326 and the upper bearing 330.

The actuator mechanism may also include a neutral detent mechanism 340 to hold the plunger 282 (and the coupled clutches 278, 280) in the neutral position. FIG. 4 illustrates an embodiment of the neutral detent mechanism 340 used with a hollow plunger 282 in which the detent mechanism cooperates between the plunger 282 and the inner propulsion shaft 254, and is located at the front end of the inner propulsion shaft 254.

The neutral detent mechanism 340 is formed in part by at least one, and preferably at least two, transversely positioned holes in the plunger 282. These holes receive detent balls 342. The detent balls 342 each have a diameter which is slightly smaller than the diameter of the transverse holes in the plunger 282.

As understood from FIG. 4, the inner propulsion shaft 254 includes an annular groove 344 which is formed on the inner wall of the bore 284 through which the plunger 282 slides. The groove 344 is positioned within the bore 284 so as to properly locate the clutches 278, 280 in the neutral position when the detent holes of the plunger 282 coincide with the axial position of the annular groove 344. A spring plunger 346, formed in part by a helical compression spring, biases the detent balls 342 radially outwardly against the inner wall of the inner propulsion shaft bore 284. The plunger 282 contains the spring plunger 346 within its bore 286.

The spring plunger 346 forces portions of the detent balls 342 into the annular groove 344 when the plunger 282 is moved into the neutral position. This releasable connection between the detent balls 342 carried by the plunger 282 and the groove 344 of the inner propulsion shaft 254 releasably restrains movement of the plunger 282 relative to the inner propulsion shaft 254, as known in the art. Because the detent mechanism 340 is believed to be conventional, further description of the detent mechanism 240 is thought unnecessary for an understanding of the present transmission 36.

Shaft Assembly and Propulsion System

With reference to FIGS. 3 and 4, the inner and outer propulsion shafts 254, 272 extend from the transmission 36 to the propulsion device 38 to drive the propulsion device 38 when selectively driven by the transmission 36. In the illustrated embodiment, the front end of the propulsion shaft 254 is supported within the lower unit 28 in front of the front gear 246. A needle-bearing assembly 348 journals the front end of the propulsion shaft 254 in this position. The inner propulsion shaft 254, as noted above, extends through the front gear hub 250 and the rear gear hub 265. On the rear side of the front gear 246, the inner shaft 254 extends through the outer shaft 272 and, as seen in FIG. 3, is suitably journaled therein in part by a needle-bearing assembly 350 which supports the inner shaft 254 at the rear end of the outer shaft 272.

The inner shaft 254 includes a central lubricant passage 352 which extends from the rear end of the longitudinal bore 284 to a plurality of transverse holes 354 positioned proximate to the rear needle bearing assembly 350. This passage 352 permits lubricant flow between the inner and outer shafts 254, 272 and to the rear needle bearing assembly 350. As shown in FIG. 4, the inner shaft 254 can include additional transverse holes along its length to provide further lubricant passages into the space between the inner and outer shafts 254, 272.

As seen in FIG. 3, a first pair of seals 356 (e.g., oil seals) is interposed between the inner shaft 254 and the outer shaft 272 at the rear end of the outer shaft 272. The seals 356 substantially prevent lubricant flow beyond this point.

With reference to FIG. 4, the outer shaft 272 includes a narrow front end which supports the external spline that engage the rear clutch 280. The front end of the outer shaft 272 lies within a step formed on the inner shaft 254. An anti-friction washer 358 sits within the step to minimize friction between the counter-rotating shafts 254, 272.

The outer shaft 272 extends through the bore of the rear gear hub 265. A metal bushing 359 journals the rear gear 248 about the outer shaft 272.

The outer shaft 272 includes a thrust flange 360 formed behind the front end of the outer shaft 272 and positioned to engage an inner race 362 of the rear thrust bearing assembly 268. The thrust flange 360 loads the inner race 362 of the bearing assembly 268 in an opposite direction to the force loading applied by the rear gear 248. This thrust bearing arrangement thus reduces the thrust loading on the rear thrust bearing assembly 268 as the opposing loads cancel each other to some degree. The resultant forward thrust loading produced under a forward drive condition is transferred to the outer race 364 of the bearing assembly 268 and then to the shim ring 270 fixed within the lower unit 28.

Figure 5:
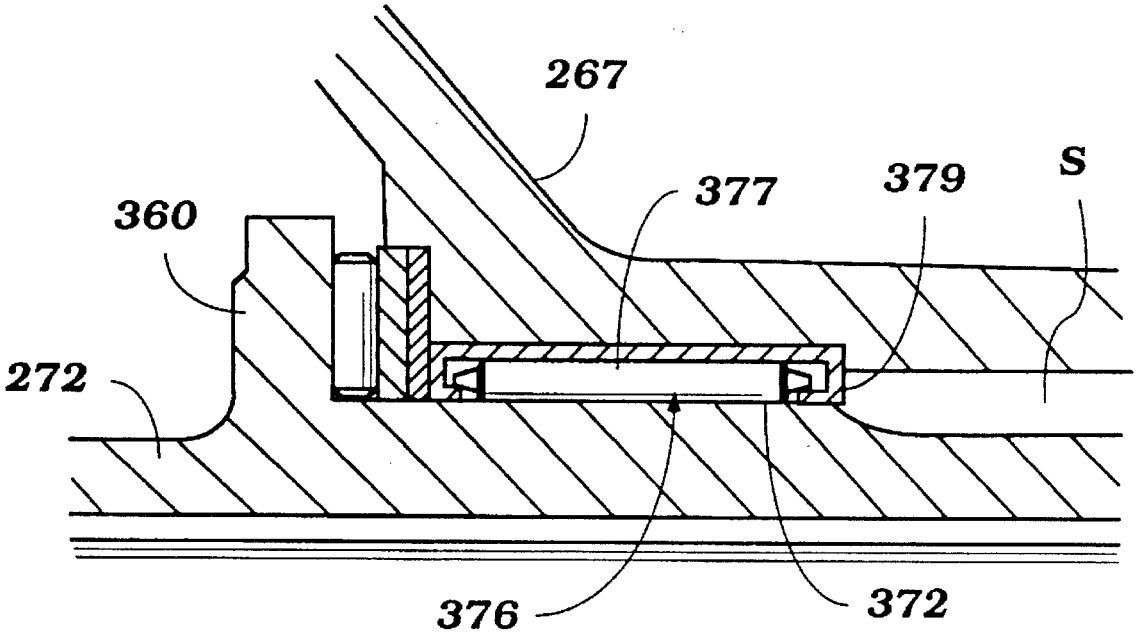
FIG. 5 is an enlarged, sectional side elevational view of the area within circle A of FIG. 3, illustrating a thrust bearing arrangement of the transmission of FIG. 3.
Figure 5:
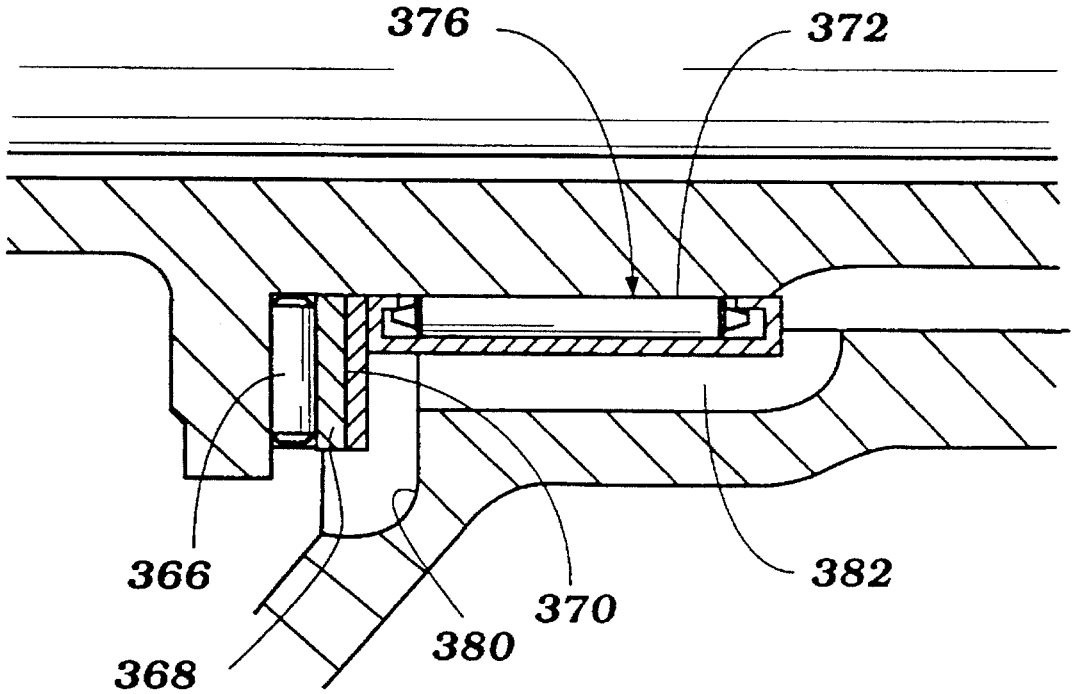

As best seen in FIG. 5, the rear side of the thrust flange 360 contacts a needle-like thrust-bearing assembly 366 which acts against an anti-friction washer 368. The anti-friction washer 368 in turn contacts a metal washer 370 seated against an inner shoulder within the bearing carrier 267. The anti-friction washer 368 minimizes friction between the bearing carrier 267 and the rotating outer shaft 272, while allowing the transfer of a rearward thrust loading from the shaft 272 to the bearing carrier 267.

As best seen in FIG. 3, the outer shaft 272 includes a pair of spaced bearing surfaces 372, 374 formed behind the thrust flange 360. The outer shaft 272 has a reduced diameter between the bearing surfaces 372, 374 to form a lubricant passage S between the bearing surfaces. The outer shaft 272 can also include a plurality of transverse holes 375 which permit lubricant flow into the space between the inner and outer propulsion shafts 254, 272.

With reference to FIGS. 3, 4 and 5, the bearing carrier 267 includes recesses which receive needle-bearing assemblies 376, 378 at positions corresponding to the actual position of the bearing surfaces 372, 374 of the outer shaft 272. Each bearing assembly 376, 378 includes a plurality of needle bearings 377 which are maintained within an outer race 379.

When assembled, the needle-bearing assemblies 376, 378 journal the outer shaft 272 within the bearing carrier 267 as bearing surfaces 372, 374 to the rear of the rear gear 248. As best seen in FIG. 5, the front bearing assembly 376 lies directly behind the thrust flange 360 and corresponding bearing assembly 366. And, as seen in FIG. 3, the rear bearing assembly 378 lies at the rear of the bearing carrier 267.

As best seen in FIG. 5, the bearing carrier 267 also includes lubricant passages 380, 382 about the rear thrust bearing assembly 366 and the front needle-bearing assembly 376 to permit lubricant flow into the space S between the bearing assembly 366 and the outer shaft 272. As best seen in FIG. 3, a second pair of lubricant seals 384 are positioned at the rear end of the bearing carrier 267 on the rear side of the rear bearing assembly 378. The lubricant seals 384 prevent lubricant flow beyond this point.

As noted above, the propeller shafts 254, 272, when coupled to the drive shaft 24 by the transmission 36, drive the propulsion device 38. The propulsion device 38 will now be described principally in reference to FIG. 3.

As seen in FIG. 3, the inner shaft 254 extends beyond the rear end of the outer shaft 272. The rear end of the inner shaft 254 carries an engagement sleeve 386 having a spline connection with the rear end of the inner shaft 254. The sleeve 386 is fixed to the inner shaft rear end between a nut 388 on the rear end of the shaft 254 and an annular rear thrust washer 390 that engages the inner shaft proximate to the rear end of the outer shaft 272.

The inner shaft 254 also carries a first propeller boss 392. An elastic bushing 394 is interposed between the engagement sleeve 386 and the propeller boss 392 and is compressed therebetween. The bushing 394 is secured to the engagement sleeve 386 by a heat process known in the art. The frictional engagement between the boss 392, the elastic bushing 394, and the engagement sleeve 386 is sufficient to transmit rotational forces from the sleeve 386, driven by the inner propulsion shaft 254, to the rear propeller 40 attached to the propeller boss 392.

The propeller boss 392 has an inner sleeve 396 and an outer sleeve 398 to which the propeller blades 400 are integrally formed. A plurality of ribs 402 extend between the inner sleeve 396 and the outer sleeve 398 to support the outer sleeve 398 about the inner sleeve 396 and to form a passage $P_1$ through the propeller boss 394. Engine exhaust is discharged through the passage $P_1$, as known in the art.

Forward driving thrusts produced by the rear propeller 40 are transferred from the propeller boss 392 to the inner shaft 254 through the rear thrust washer 390. As best understood from FIG. 6, the thrust washer 390 includes an annular body with a central hole 404 sized to receive the inner propulsion shaft 254. The central hole 404 includes a tapering or stepped diameter which corresponds to the shape of the inner shaft 254 proximate to the rear end of the outer shaft 272. In the illustrated embodiment, the hole 404 of the thrust washer 390 is larger on its front side than its rear side. In this manner, an interference fit or physical contact is produced as the rear thrust washer 390 slides over the inner shaft 254 in a forward direction and registers against the shaft 254 proximate to the rear end of the outer shaft 272.

The thrust washer 390 also includes a forward projecting hub 406. The hub 406 has an outer diameter which substantially matches that of the diameter of the outer shaft 272 at its rear end. An annular groove 408 circumscribes the hub 406 at the point from which the hub projects from the body of the thrust washer 390. The groove 408 desirably has an arcuate bottom surface in order to reduce stress risers. The thrust washer 390 also includes a rearwardly projecting second hub 410 which forms an annular shoulder.

A cap washer 412 is positioned between the rear end of the thrust washer hub 410 and about the front end of the engagement sleeve 386. The diameters of the thrust washer hub 410 and the cap washer 412 preferably are sized so as to lie within a front end of the inner sleeve 396 of the propeller boss 392 by a small distance $\delta_2$.

With reference back to FIG. 3, the rear end portion of the outer shaft 272 carries a front engagement sleeve 414 in driving engagement thereabouts by a spline connection. The second engagement sleeve 414 is secured onto the outer shaft 272 between an end cap 416 and a front thrust washer 418.

Figure 6:
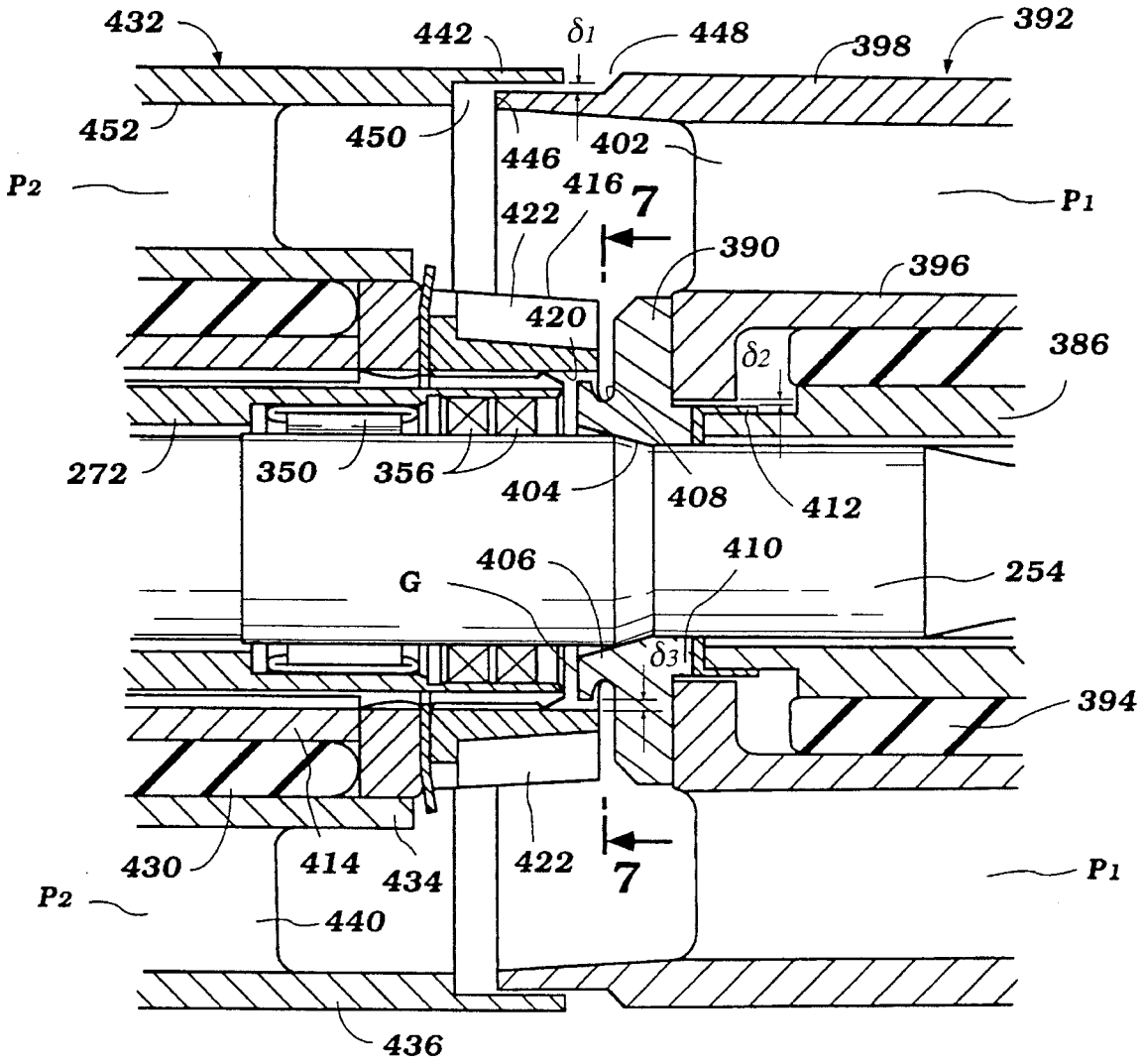
FIG. 6 is an enlarged, sectional side elevational view of the area within circle B of FIG. 3, illustrating a rear interface region between front and rear propeller hubs of a propulsion unit of FIG. 3.

As best seen in FIG. 6, the end cap 416 attaches to the rear end of the outer shaft 272. In an illustrated embodiment, the end cap is a retaining nut 416 and includes internal threads which cooperate with external threads formed on the rear end of the outer shaft 272. The internal threads on an inner bore 420 of the retaining nut 416, however, desirably do not extend along the entire axial length of the nut 416, but extend only from the front end of the nut 416 to a point proximate the midsection of the nut 416. The bore 420 thus has a smooth surface at the rear end of the nut 416; however, the internal threads may extend along the entire length of the bore 420.

When assembled, as seen in FIG. 6, the nut 416 threads only partially onto the end of the outer shaft 272 in order to secure the front propeller 42 onto the outer shaft 272. So positioned, the rear end of the outer shaft 272 does not extend through the entire bore 420 of the nut 416. The retaining nut 416 projects beyond the rear end of the outer shaft 272.

The bore 420 of the retaining nut 416 is sized to receive a portion of the front hub 406 of the rear thrust washer 390.

The retaining nut 416 and the thrust washer 390 desirably are arranged such that the rear end of the retaining nut 416 overlaps at least a portion of the annular groove 408 formed on the front hub 406 of the thrust washer 390 in the axial direction, without the front end of the front hub 406 contacting the rear end of the outer shaft 272. The front hub 406 desirably lies away from the rear end of the outer shaft 272 by a sufficient amount to prevent contact and/or frictional engagement between these two components, which rotate in opposite directions under at least one drive condition (e.g. forward drive).

Figure 7:
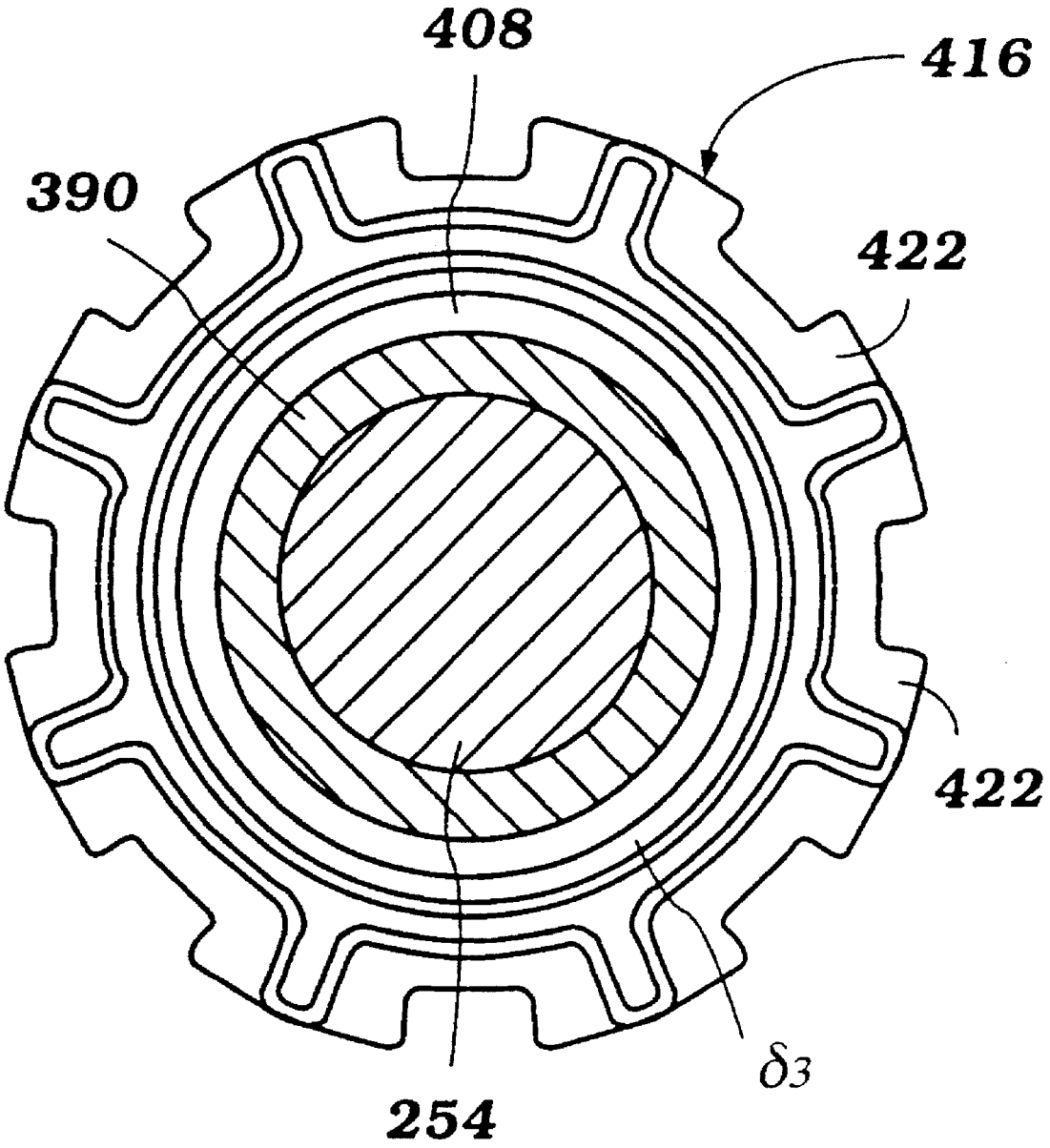
FIG. 7 is a cross-sectional view of a propulsion shaft assembly taken along line 7—7 of FIG. 6.

As best understood from FIGS. 6 and 7, the outer diameter of the hub 406 is slightly smaller than the inner diameter of the bore 420 of the retaining nut 416. A small gap $\delta_3$ formed between the cap 416 and the thrust washer hub 406 allows the cap 416 and thrust washer 390 to rotate in opposite direction without contact, while substantially closing the space G (FIG. 6) between the thrust washer hub 406 and the rear end of the outer shaft 272, proximate to the lubricant seals 356.

As also seen in FIGS. 6 and 7, the retaining nut 416 includes a plurality of reliefs 422 formed about the periphery of the nut 416, as known in the art. The reliefs 422 are sized and positioned to receive a conventional tool used to tighten the retaining nut 416 onto the end of the outer shaft 272.

With reference to FIG. 6, the overlapping arrangement between the retaining nut 416 and the rear thrust washer 390 form a labyrinth passageway into the space G proximate to the lubrication seals 356. That is, as seen in FIG. 6, the periphery of the inner shaft 254 is not directly exposed to the exhaust passages $P_1$, $P_2$ of the propeller bosses 392, 432. At least three change in directions are required to enter the space G between the rear end of the outer shaft 272 and the front end of the thrust washer hub 406. In addition, the spacing $\delta_3$ between the retaining nut 416 and the front hub 406 of the rear thrust washer 390 is minimal, and the annular groove 408 on the thrust washer hub 406 acts as a trap to prevent weeds and like debris from migrating forward into the space $\delta_3$ between the front end of the thrust bearing hub 406 and the inner wall of the retaining nut bore 420.

With reference back to FIG. 3, the front propeller 42 includes a second elastic bushing 430 which surrounds the second engagement sleeve 414. The bushing 430 is secured to the sleeve 414 by a heat process known in the art.

A second propeller boss 432 surrounds the elastic bushing 430, which is held under pressure between the boss 432 and the sleeve 414 in frictional engagement. The frictional engagement between the propeller boss 432 and the bushing 430 is sufficient to transmit a rotational force from the sleeve 414 to the second propeller boss 432.

Similar to the first propeller boss 392, the second propeller boss 432 has an inner sleeve 434 and an outer sleeve 436. Propeller blades 438 of the second propeller 42 are integrally formed on the exterior of the outer sleeve 436. Ribs 440 interconnect the inner sleeve 434 and the outer sleeve 436 and form an axially-extending passage $P_2$ between the sleeves 434, 436 that communicate with the exhaust passage 29 in the lower unit 28 and with the exhaust passage $P_1$ of the first propeller boss 392.

As best seen in FIG. 6, the rear end 442 of the front boss 432 and the front end 446 of the rear boss 392 generally lie adjacent to each other so as to form a continuous exhaust discharge passage. The adjacent ends 442, 446 of the front and rear bosses 432, 392 desirably overlap in the axial direction to generally seal the exhaust passage formed by passages $P_1$ and $P_2$ within the front and rear bosses 432, 392.

In the illustrated embodiment, as best seen in FIG. 6, the outer sleeve 398 of the rear boss 392 includes a seat 448 in the form of a step at the front end 446 on the exterior surface of the outer sleeve 398. At the seat 448, the outer sleeve 398 has a smaller outer diameter than the general outer diameter of the outer sleeve 398. The seat 448 desirably continues around the entire circumference of the outer sleeve 398.

Similarly, the outer sleeve 436 of the front boss 432 includes a relief 450 on its inner surface 452 at the rear end 442 of the front boss 432. At the relief 450, the outer sleeve 436 has a larger inner diameter than the general inner diameter of the sleeve inner surface 452. The relief 450 desirably continues around the entire inner circumference of the sleeve inner surface 452.

The cooperating seat 448 and relief 450 are sufficiently sized such that the corresponding ends 442, 446 overlap without contact between the front and rear bosses 432, 392. As seen in FIG. 6, the overlapping ends 442, 446 form a small gap $\delta_1$ at the joint between the two propellers 40, 42. The gap $\delta_1$ formed at the overlapping ends 442, 446 of the front and rear bosses 432, 392 desirably is larger than the gap $\delta_2$ formed between the front end of the inner sleeve 396 of the rear propeller boss 392 and either of the cap washer 412 covering the front end of the engagement sleeve 398 or the thrust washer hub 410.

When the propellers 40, 42 rotate, the elastic bushing 394 may deform causing the propeller boss 392 to shift relative to the axis of the inner shaft 254. If there is not enough clearance between the front end 446 of the rear outer sleeve 398 and the rear end 442 of the front outer sleeve 436, the ends 442, 446 will contact each other which can damage the oppositely rotating propeller bosses 392, 432. In order to prevent contact between the overlapping ends 442, 446, the gap $\delta_2$ formed between the cap washer 412 (and/or the thrust washer hub 410) and the inner sleeve 396 of the rear propeller 40 is smaller than the gap $\delta_1$ between the overlapping ends 442, 446. The inner sleeve 396 of the rear propeller 40 contacts the washer 412 when the elastic bushing 394 deforms to limit the extent to which the boss 392 can shift relative to the shaft axis. In this manner, the corresponding ends 442, 446 of the front and rear bosses 432, 392 are prevented from contacting each other when the elastic bushing 394 deforms.

The gap $\delta_1$ is also smaller than prior gap spacings $\delta$ (FIG. 2) between the propeller hubs. This spacing better seals the exhaust passages $P_1$ and $P_2$, while further inhibiting the inflow of debris into the propeller boss passages $P_1$ and $P_2$.

Although this invention has been described in terms of certain preferred embodiments, other embodiments apparent to those of ordinary skill in the art are also within the scope of this invention. Accordingly, the scope of the invention is intended to be defined only by the claims which follow.

In addition, the headings provided above are for convenience only and should not be interpreted to limit or affect, in any way, the scope of the present invention.

What is claimed is:

1. A propulsion shaft assembly for a marine propulsion system comprising a hollow outer shaft and a coaxial inner shaft which extends beyond a rear end of the outer shaft, said inner and outer shafts arranged to define a space between an inner diameter of said hollow outer shaft and an outer diameter of said inner shaft, a thrust washer carried by said inner shaft at a position proximate to said rear end of said outer shaft, and a hollow end cap carried by the outer shaft at its rear end, a portion of said end cap covering a portion of said thrust washer so as to form a generally labyrinth path into the space defined between said inner and outer shafts.

2. A propulsion shaft assembly as in claim 1 additionally comprising at least one lubricant seal positioned between said inner and outer shafts, proximate to the portion of the thrust washer covered by said portion of the end cap, said seal arranged to seal the space at the rear end of the outer shaft.

3. A propulsion shaft assembly as in claim 1, wherein said end cap includes an internal thread which threads onto the rear end of the outer shaft.

4. A propulsion shaft assembly as in claim 1, wherein said end cap is sized to cooperate with an end of a propeller device to secure the propeller device on said outer shaft.

5. A propulsion shaft assembly as in claim 1, wherein said thrust washer includes a hub and an annular groove which circumscribes the hub, said end cap covering at least a portion of said annular groove.

6. A propulsion shaft assembly as in claim 5, wherein said end cap covers an end of said thrust washer hub, said end of said thrust washer hub having an outer diameter of generally the same size as the outer diameter of the outer shaft at its rear end.

7. A propulsion shaft assembly as in claim 5, wherein said thrust washer includes a bore which receives said inner shaft, said bore including a varying diameter which registers against a similarly shaped section of said inner shaft.

8. A propulsion shaft assembly as in claim 1, wherein the labyrinth path is defined between said end cap, thrust washer and rear end of said outer shaft, and includes at least three changes in direction.

9. A propulsion shaft assembly for a counter-rotating propeller system comprising an inner shaft passing through and extending beyond a rear end of a coaxial outer propulsion shaft, said shafts extending along a common drive axis, at least one lubricant seal positioned between said inner and outer shafts proximate to the rear end of said outer shaft, a first member coupled to said inner shaft in a manner permitting the transfer of a forward thrust loading on said first member to the inner shaft and a second member coupled to said outer shaft, said first and second members at least partially overlapping in the direction of the drive axis with a forward-most end of said first member opposing the rear end of said outer shaft in a direction of the drive axis to protect the lubricant seal.

10. A propulsion shaft assembly as in claim 9, additionally comprising a front propeller hub driven by said outer propulsion shaft and a rear propeller hub driven by said inner propulsion shaft, said front and rear propeller hubs overlapping in the direction of the drive axis, the overlapping portions of said front and rear propeller hubs being spaced apart by a first distance, said rear hub being supported about said inner propulsion shaft at a second distance from a contact surface connected to said first propulsion shaft, said second distance being smaller than said first distance.

11. A propulsion shaft assembly as in claim 9, wherein said first member is a thrust washer.

12. A propulsion shaft assembly as in claim 11, wherein said second member is a retaining nut at least partially threaded onto the rear end of said outer shaft.

13. A propulsion shaft assembly as in claim 12, wherein a portion of said retaining nut projects beyond the rear end of the outer shaft toward said thrust washer.

14. A propulsion shaft assembly as in claim 13, wherein said thrust washer includes a hub which projects into said retaining nut.

15. A propulsion shaft assembly as in claim 14, wherein said hub has a diameter of generally the same size as the outer diameter of the outer shaft at its rear end.

16. A propulsion shaft assembly as in claim 14, wherein said hub includes an annular groove which circumscribes said hub, and at least a portion of said groove lies within said retaining nut.

17. A propulsion shaft assembly for a marine drive comprising first and second coaxial, counter-rotating propulsion shafts which define a space between them, said first shaft arranged to extend beyond an end of said second shaft, said first shaft including a first member which circumscribes the first shaft and said second shaft includes a second member which releasably attaches to said second shaft to secure a propulsion device to said second shaft, said first and second members arranged relative to each other to form a labyrinth path into said space between said first and second shafts.

18. A propulsion shaft assembly as in claim 17, wherein said second member extends beyond said end of said second shaft toward said first member.

19. A propulsion shaft assembly as in claim 18, wherein said first and second members overlap in a direction parallel to the longitudinal axis of said first and second propulsion shafts.

20. A propulsion shaft assembly as in claim 19, wherein the labyrinth path between said first and second members and into the space between the first and second propulsion shafts includes at least three changes in direction.

21. A propulsion system for a marine drive comprising first and second coaxial, counter-rotating propulsion shafts which extend along a drive axis, said first shaft coupled to a first propeller hub and said second shaft coupled to a second propeller hub, said first and second propeller hubs being arranged in series adjacent to each other with adjacent ends of said propeller hubs overlapping in the direction of the drive axis, said overlapping ends being spaced apart in a direction transverse to the drive axis by a first distance, said first hub being supported about said first propulsion shaft at a second distance from a contact surface connected to said first propulsion shaft, said second distance being smaller than said first distance.

22. A propulsion system as in claim 21, wherein said contact surface is formed by a cap washer carried by said first propulsion shaft.

23. A propulsion system as in claim 21 additionally comprising a thrust washer carried by said first propulsion shaft, said thrust washer including an annular hub which forms said contact surface.

24. A propulsion system as in claim 21 additionally comprising a torsionally resistant coupling which couples said first propeller hub to said first propulsion shaft.

25. A propulsion shaft assembly for a counter-rotating propeller system comprising a front propulsion assembly and a rear propulsion assembly, said rear propulsion assembly including an inner shaft passing through and extending beyond a rear end of a coaxial outer propulsion shaft of said front propulsion assembly, said shafts extending along a common drive axis, at least one lubricant seal positioned in a space defined between said inner and outer shaft proximate to the rear end of said outer shaft, and a thrust washer coupled to said inner shaft at a position near the rear end of said outer propulsion shaft, said thrust washer extending forward of a rear end of a portion of said front propulsion assembly in a direction along the drive axis, said thrust washer and said front propulsion assembly arranged to form a generally labyrinth path into the space defined between said inner and outer shafts, said labyrinth path having at least three sections arranged relative to each other to require two directional changes along the labyrinth path from a point external to the outer shaft into the space between the inner and outer shafts.

26. A propeller shaft assembly as in claim 25, wherein said thrust washer extends beyond a rear end of a end cap carried by said outer shaft.

* * * * *